US006329755B1

(12) United States Patent
Nakade et al.

(10) Patent No.: US 6,329,755 B1
(45) Date of Patent: Dec. 11, 2001

(54) LIGHT ADJUSTMENT DEVICE FOR A VEHICLE

(75) Inventors: Yoshiyuki Nakade; Shigeyoshi Umezawa, both of Tsuruga; Masahiro Takamatsu; Shigeo Shigeyama, both of Toyota, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/722,619

(22) Filed: Nov. 28, 2000

(30) Foreign Application Priority Data

Nov. 29, 1999 (JP) ..... 11-337391

(51) Int. Cl.[7] ..... H05B 37/00
(52) U.S. Cl. ..... 315/82; 315/178; 315/224
(58) Field of Search ..... 315/82, 158, 159, 315/151, 224, 178; 307/10.8

(56) References Cited

U.S. PATENT DOCUMENTS 4,463,284 * 7/1984 Tamura et al. ..... 315/158

FOREIGN PATENT DOCUMENTS 61101049 6/1986 (JP) .

OTHER PUBLICATIONS

English Language Abstract of JP 61–101049.

* cited by examiner

*Primary Examiner*—David Vu
(74) *Attorney, Agent, or Firm*—Greenblum & Bernstein, P.L.C.

(57) ABSTRACT

A light adjustment device for a vehicle comprises: a control circuit 8 connected to a lamp 2; a first variable resistor 20 for adjusting the intensity of illumination of the lamp 2 by changing the output voltage of the control circuit 8; and a second variable resistor, having different resistance value characteristics to the first variable resistor 20, for adjusting the intensity of illumination of the LED 4.

4 Claims, 13 Drawing Sheets

LIGHT ADJUSTMENT DEVICE FOR A VEHICLE

BACKGROUND OF THE INVENTION

1. Field of the Invention

The present invention relates to a light adjustment device for a vehicle used to control illumination of the display panel, operating panel, or the like, of a vehicle.

2. Description of the Related Art

In a vehicle, illumination of various meters on the display panel and knobs on the operating panel, or the like, is performed by means of lamps, LEDs, and the like. A conventional light adjustment device for controlling illumination of these is constituted such that the amount of light emitted by the lamps or LEDs is adjusted by changing the output voltage of a control circuit by operation of a variable resistor.

A prior art example is described below with reference to FIG. 11 to FIG. 13. FIG. 11 is a circuit diagram of a conventional light adjusting device for a vehicle. Reference numeral 1 represents a terminal for connection to a power source, such as a battery, reference numeral 2 represents a lamp for illuminating an indicator 3, such as shown in FIG. 2, and reference numeral 4 represents an LED for illuminating meters 5, such as the speedometer and fuel gauge, and the like, as shown in FIG. 2. An anti-surge diode 6 and a current-limiting fixed resistance 7 are connected to the LED 4. Reference numeral 8 denotes a control circuit generating a constant voltage waveform and reference numeral 9 indicates a rotationally operated variable resistor which is connected to the control circuit 8. A current control transistor 10 is connected between the control circuit 8 and the lamp 2 and LED 4. Reference numeral 11 in FIG. 2 indicates an operating spindle 11 of the variable resistor 9; by rotating this operating spindle 11, the angle of the variable resistor 9 is changed. The variable resistor 9 exhibits resistance characteristics R10 as shown in FIG. 12. As can be seen, the resistance value is changed linearly in proportion to the operating angle of the variable resistor 9.

In this prior art light adjustment device for a vehicle, light adjustment is performed by rotating the variable resistor 9, whereby the output voltage from the control circuit 8 changes and the current flowing through the transistor 10 is altered accordingly, hence causing the intensity of illumination of the lamp 2 and LED 4 to change and therefore causing the brightness of illumination of the indicators 3 and the meters 5 on the display panel to vary.

FIG. 13 is a plot of illumination intensity (%) versus voltage showing the illumination characteristics of the lamp 2 and the LED 4 according to the prior art. As shown, the illumination characteristics L10 of the lamp 2 which illuminates the indicators 3 are expressed in a curve, whereas the illumination characteristics L20 of the LED 4 which illuminates the meters 5 are expressed in a straight line. Also, it can be seen that the LED 4 has a greater illumination intensity.

In the conventional light adjustment device for a vehicle, the light adjustment is performed by the variable resistor 9 simultaneously changing the respective intensities of illumination of the lamp 2 and LED 4 having such different characteristics. Since the variable resistor 9 has resistance value characteristics which are expressed in a straight line R10 as shown in FIG. 12, when the variable resistor 9 is rotated at a given angle whereby a given voltage is applied to both of the lamp 2 and the LED 4, the intensities of illumination of the lamp 2 and LED 4 at this given voltage will be different. As a result, a disparity is produced in the brightness of the indicators 3 which are illuminated by the lamp 2 and the meters 5 which are illuminated by the LED 4, and consequently the display will be difficult to view properly.

SUMMARY OF THE INVENTION

In view of the foregoing, it is an object of the present invention to provide a light adjustment device for a vehicle capable of achieving uniform adjustment of respective intensities of illumination of a lamp and LED having differing illumination characteristics. In order to achieve the aforementioned object, the light adjustment device for a vehicle according to the present invention comprises a lamp, an LED, a control circuit which is connected to said lamp and outputs a predetermined voltage to said lamp, a first variable resistor for changing said voltage output from said control circuit, thereby adjusting illumination of said lamp, and a second variable resistor, having resistance value characteristics that are different from resistance value characteristics of said first variable resistor, for adjusting illumination of said LED.

According to the present invention, either one of the first variable resistor or the second variable resistor has resistance value characteristics that are expressed by a straight line in a plot of resistance value versus operating angle of the variable resistor, while the other has resistance characteristics expressed by a curve. Illumination of the lamp and the LED are respectively controlled by these first and second variable resistors having mutually different resistance value characteristics. It is therefore possible to achieve uniform adjustment of illumination in such a manner that there is no disparity in the degree of illumination of indicators which are illuminated by the lamp and of meters which are illuminated by the LED, on a display panel.

In the invention described above, the first variable resistor and second variable resistor may be operated by the same operating spindle, so that light adjustment of both the lamp and LED can be readily performed.

Furthermore, in the invention described above, it is possible to connect a plurality of fixed resistors to the lamp or LED, instead of at least one of the first variable resistor and the second variable resistor. Thereby, light adjustment can be performed by switching between the plurality of fixed resistors connected to the lamp or LED by operating the operating spindle, and hence the structure of the light adjustment device for a vehicle can be simplified and the device can be made inexpensively.

In the invention described above, if a switch for switching an illumination device other than the lamp and LED adjusted by the first variable resistor and the second variable resistor is provided in the vicinity of the variable resistors, or in an integral fashion with same, then a variety of functional operations can be performed manually by a vehicle occupant in a readily accessible manner. For example, it is possible to provide, in the vicinity of the first and second variable resistors, or in an integral fashion with same, a switch for switching an illumination device disposed in a separate location from the display panel or operating panel for which light adjustment is performed by the first variable resistor and second variable resistor, for example, an interior cabin light, or the like, installed in the upper part of the cabin.

While novel features of the invention are set forth in the preceding, the invention, both as to organization and content, can be further understood and appreciated, along with other objects and features thereof, from the following detailed description and examples when taken in conjunction with the attached drawings.

DESCRIPTION OF THE PREFERRED EMBODIMENTS

Figure 1:
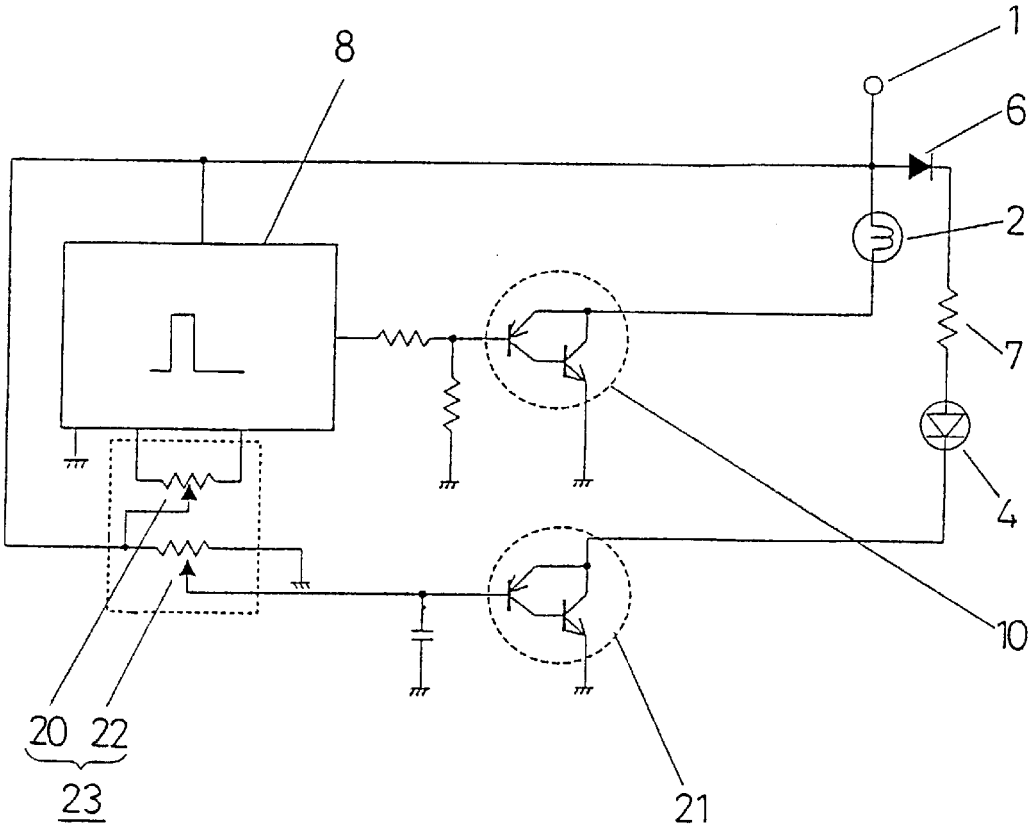
FIG. 1 is a circuit diagram showing a light adjustment device for a vehicle according to a first embodiment of the present invention.

Preferred embodiments of the present invention will be hereinafter described with reference to FIG. 1 to FIG. 10. Elements similar to those described above in relation to the prior art are given the same reference numerals and detailed description thereof is omitted here.

Figure 2:
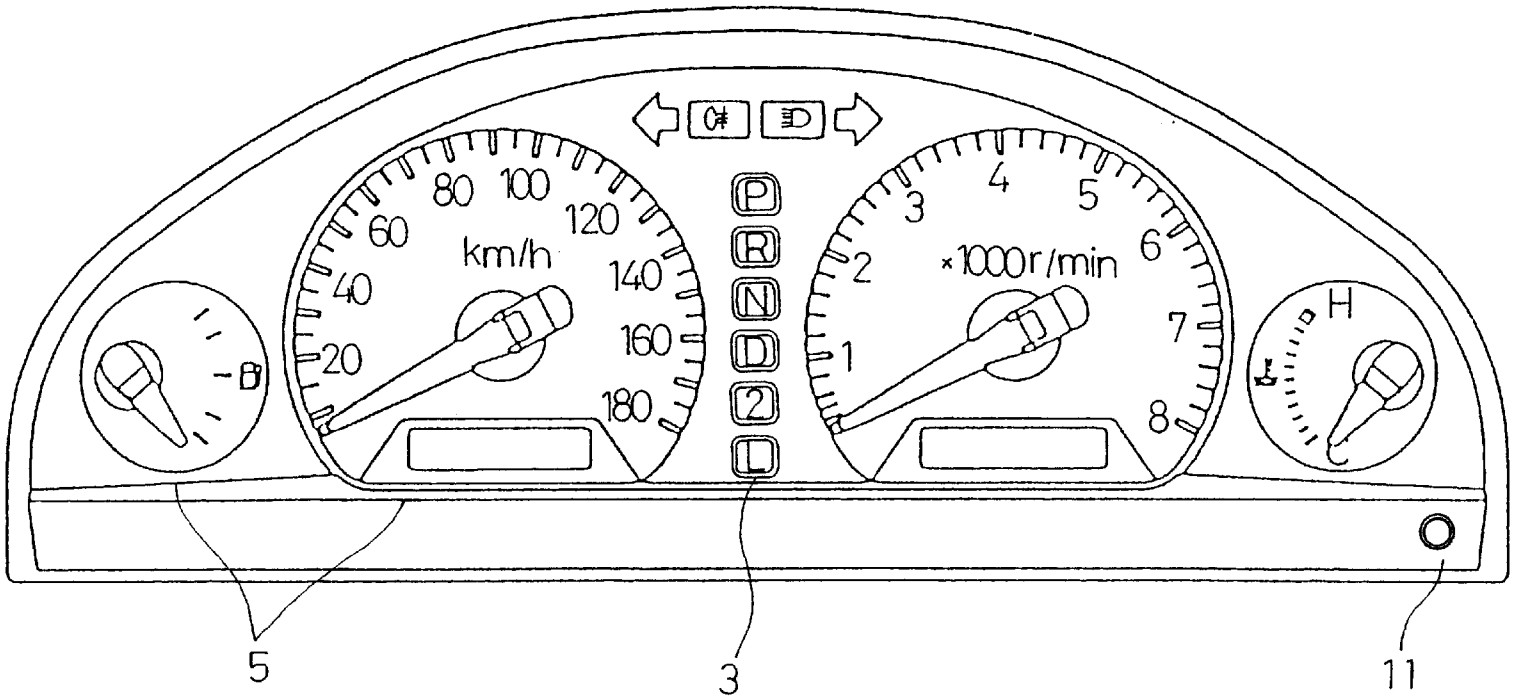
FIG. 2 is an external view showing the display panel of a vehicle.

The first embodiment of the present invention is described with reference to the circuit diagram of a light adjustment device for a vehicle shown in FIG. 1 and the external view showing one example of a display panel for a vehicle illustrated in FIG. 2. Reference numeral 1 represents a terminal for connection to a power source, such as a battery, reference numeral 2 represents a lamp for illuminating an indicator 3, and reference numeral 4 indicates an LED for illuminating meters 5, such as a speedometer, fuel gauge, and the like. A surge protection diode 6 and a current limiting fixed resistance 7 are connected to the LED 4, similarly to the prior art. Reference numeral 8 denotes a control circuit for generating a fixed voltage waveform. A first rotationally operated variable resistor 20 is connected to this control circuit 8, similarly to the prior art, and a current controlling transistor 10 is connected between the control circuit 8 and the lamp 2.

In contrast to the prior art, in this first embodiment of the present invention, a second rotationally operated variable resistor 22 is connected to the LED 4, via a current controlling transistor 21. The first variable resistor 20 and the second variable resistor 22 constitute an integrally formed variable resistor 23, in such a manner that they can be operated by means of the same operating spindle 11 shown in FIG. 2.

Figure 3:
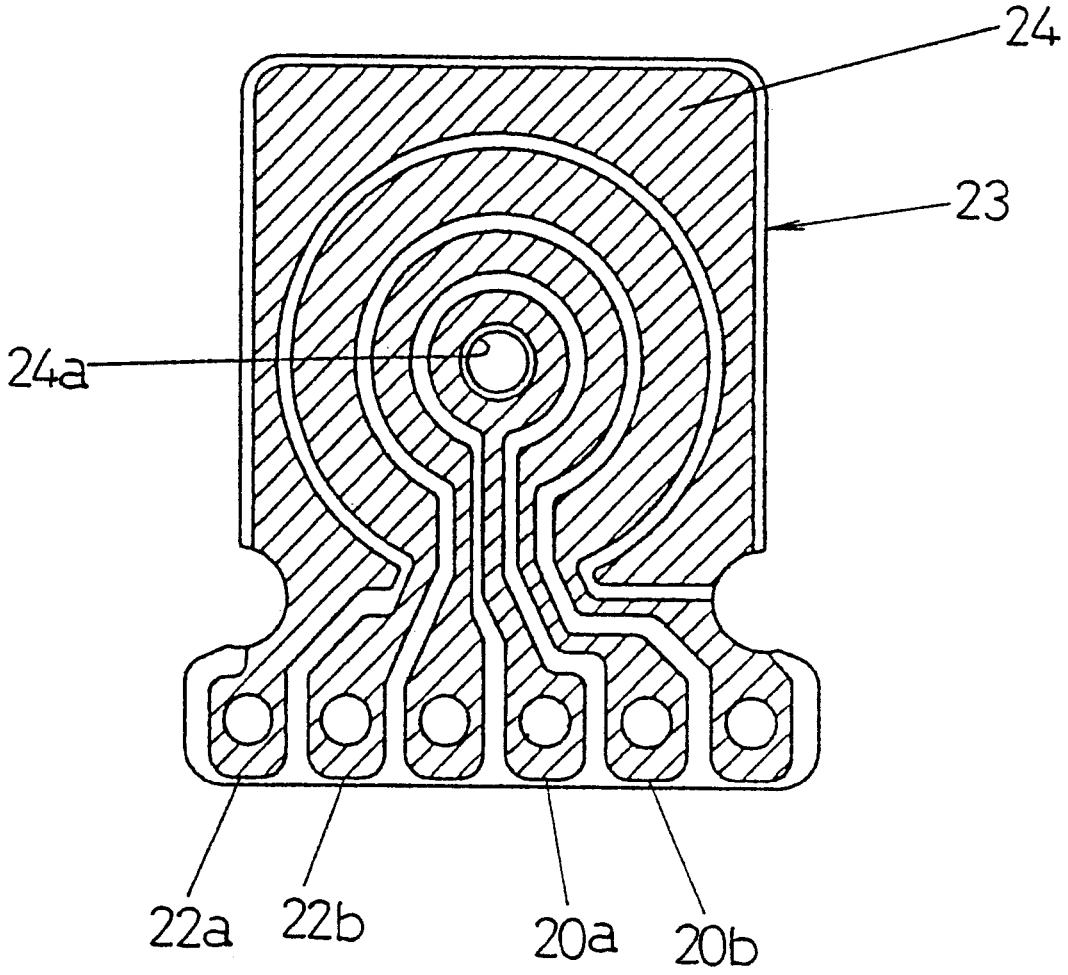
FIG. 3 is an external view of the principal part of a variable resistor in the first embodiment of the present invention.

As shown by the external view in FIG. 3, this variable resistor 23 comprises common electrodes 20*a*, 22*a*, and resistors 20*b*, 22*b* formed on the upper face of a substrate 24 made from insulating resin, and the operating spindle 11 passes through a central hole 24*a* therein.

Figure 4:
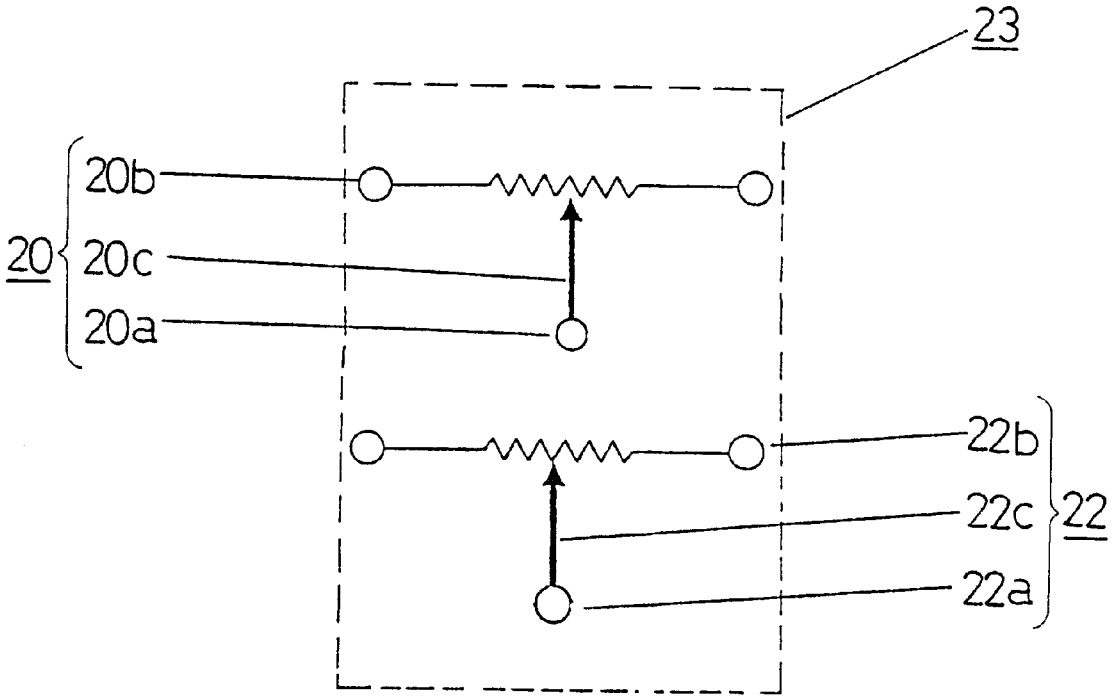
FIG. 4 is a circuit diagram of variable resistors according to the same embodiment.

As shown by the circuit diagram in FIG. 4, the first variable resistor 20 in the variable resistor 23 is constituted in such a manner that a first contact plate 20*c* made from an elastic metal sheet and attached to the operating spindle 11 provides a flexible contact between the common electrode 20*a* and the resistor 20*b*, and this first contact plate 20*c* rotates and slides over the common electrode 20*a* and the resistor 20*b*. The second variable resistor 22 is constituted in such a manner that a second contact plate 22*c* made from an elastic metal sheet and attached to the operating spindle 11 provides a flexible contact between the common electrode 22*a* and the resistor 22*b*, and this second contact plate 22*c* is able to rotate and slide over the common electrode 22*a* and the resistor 22*b*.

Figure 5:
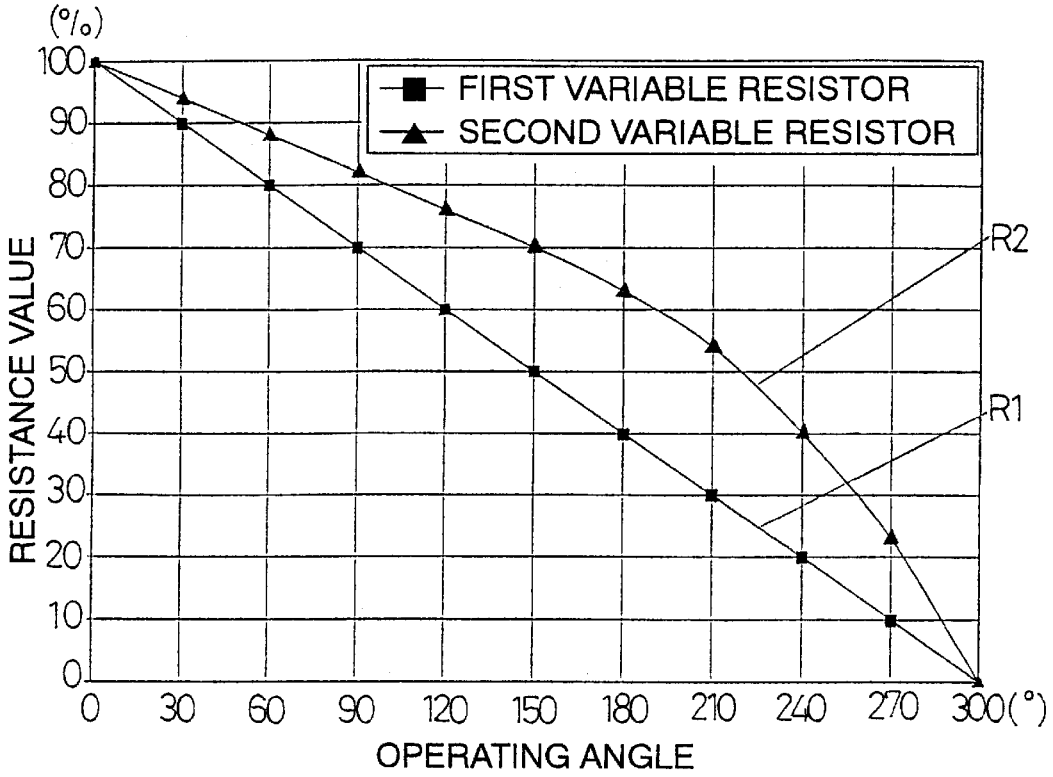
FIG. 5 is a chart showing the resistance characteristics of the variable resistors in the same embodiment.

FIG. 5 shows changes in the resistance values of the first and second variable resistors 20, 22 in accordance with the angle of operation of the operating spindle 11 in the variable resistor 23. The first variable resistor 20 has resistance characteristics R1 that are expressed in a linear fashion in accordance with the angle of operation of the operating spindle 11, similarly to a variable resistor used in the prior art. On the other hand, the resistance characteristics R2 of the second variable resistor 22 changes in a curvilinear fashion, and the second variable resistor 22 has greater resistance values than those of the first variable resistor 20.

Figure 6:
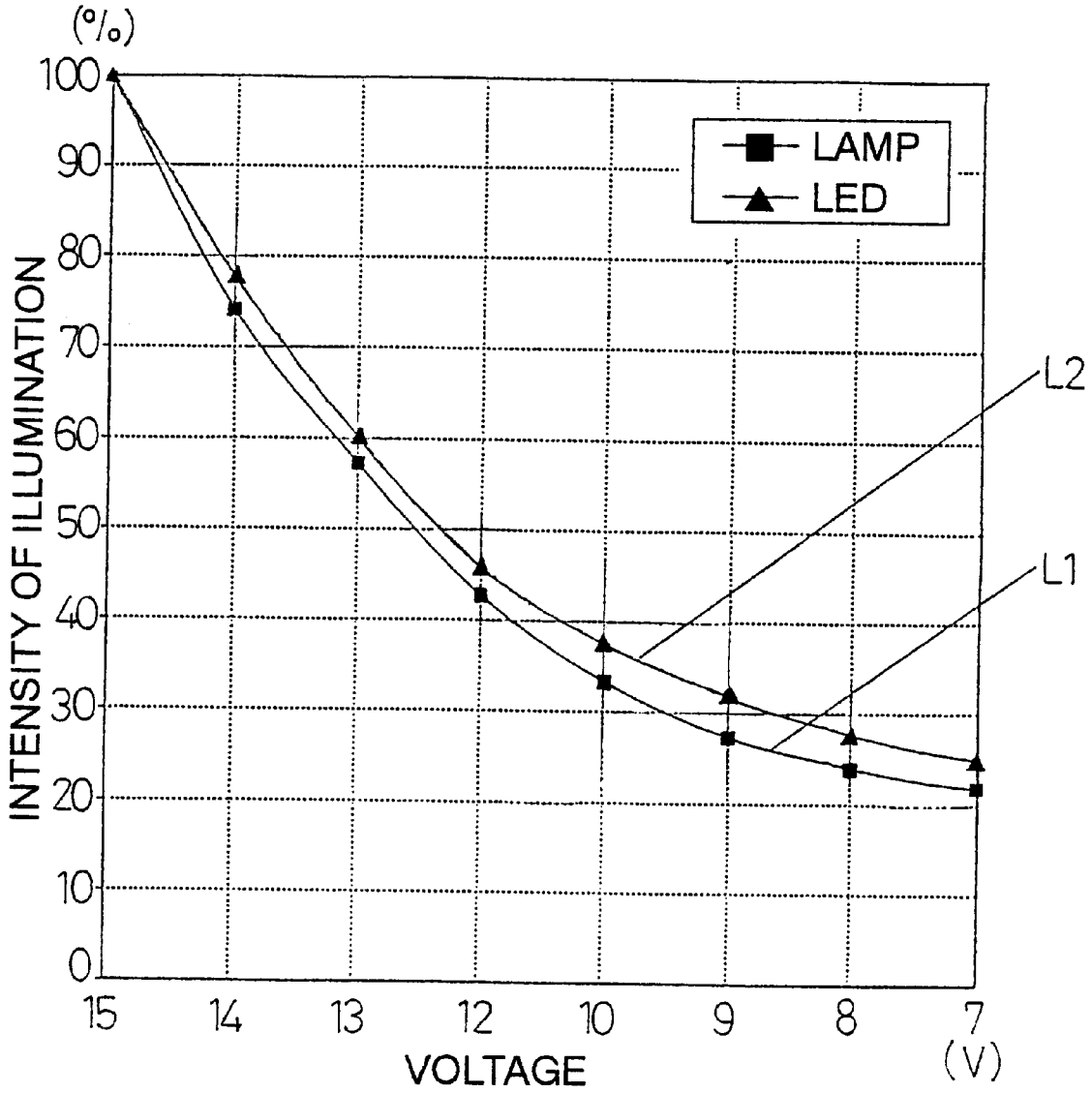
FIG. 6 is a chart showing the illumination characteristics of a lamp and LED in the same embodiment.

When the operating spindle 11 of the variable resistor 23 is turned, the resistance value of the first variable resistor 20 changes, causing the output voltage from the control circuit 8 to change, and hence the current flowing through the transistor 10 is altered accordingly. Referring to FIG. 6 which is a plot of illumination intensity (%) versus voltage showing the illumination characteristics of the lamp 2 and the LED 4, the intensity of illumination of the lamp 2 changes in a curvilinear fashion as indicated by the illumination characteristics curve L1, causing the brightness of illumination of the indicator 3 (FIG. 2) on the display panel to change and hence achieving light adjustment. Since the resistance value of the second variable resistor 22 also changes in a simultaneous manner, the intensity of illumination of the LED 4 also changes, causing the brightness of illumination of the meters 5 on the display panel to change and thereby also achieving light adjustment. In this case, since the second variable resistor 22 has larger resistance values than the first variable resistor 20 as shown in FIG. 5, and since the resistance value of the second variable resistor 22 changes in a curvilinear fashion, the intensity of illumination of the LED 4 shows illumination characteristics L2 which approximate the illumination characteristics L1 of the lamp 2. That is, the intensity of illumination of the LED 4 also changes in a curvilinear fashion.

In this way, according to a light adjustment device for a vehicle according to the first embodiment, in addition to a first variable resistor 20 for adjusting the intensity of illumination of a lamp 2, which is connected to a control circuit 8, a second variable resistor 22 for adjusting the intensity of illumination of an LED 4 is also provided. The resistance value of the first variable resistor 20 changes in a linear fashion, while the resistance value of the second variable resistor 22 changes in a curvilinear fashion, and by using these two variable resistors having different resistance characteristics, it is possible to perform uniform adjustment of illumination of the lamp 2 and LED 4.

The first variable resistor 20 and second variable resistor 22 are constituted as an integrated variable resistor 23, in such a manner that they can be operated by means of a single operating spindle 11. Therefore, the light adjustment of both the lamp 2 and the LED 4 can be easily achieved.

In the first embodiment described above, a variable resistor having resistance characteristics expressed in a straight line similarly to the prior art is used as the first variable resistor 20, whilst a variable resistor having a larger resistance value than that of the first variable resistor 20 and having resistance characteristics expressed by a curve R2 is adopted as the second variable resistor 22. The present invention is not limited to this and various modifications could be made.

Figure 7:
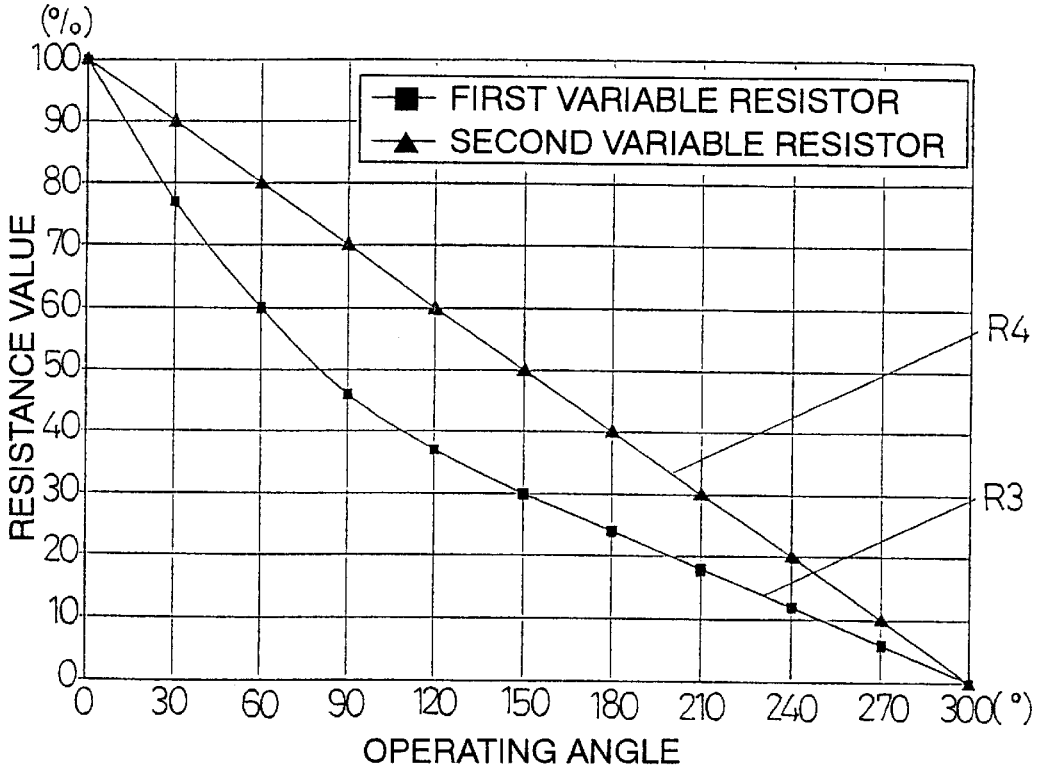
FIG. 7 is a chart showing the resistance characteristics of variable resistors in a modified example of the same embodiment.
Figure 8:
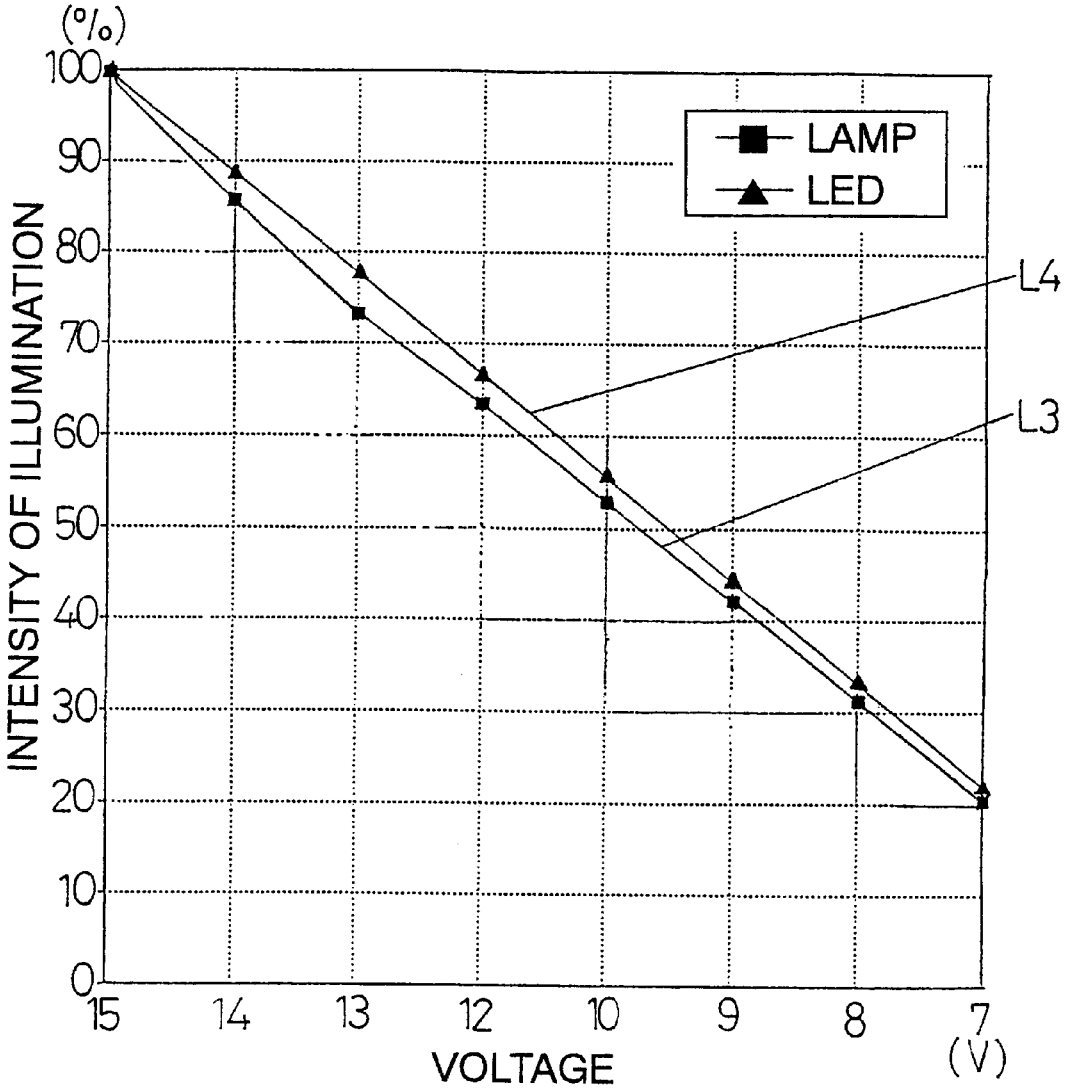
FIG. 8 is a chart showing the illumination characteristics of the lamp and LED in the modified example.

For example, as shown in FIG. 7, a variable resistor having resistance characteristics expressed by a straight line R4 may be used as the second variable resistor 22, whilst a variable resistor having a smaller resistance than this second variable resistor 22 and having resistance characteristics expressed by a curve R3 may be used as the first variable resistor 20. In this case, as shown in FIG. 8, the illumination characteristics of the LED 4 are expressed by a straight line L4, and, the curve L3 showing the illumination characteristics of the lamp 2 is considerably approximated to the LED illumination characteristics line L4. Thereby, it is possible to achieve uniform adjustment of illumination of both the lamp 2 and the LED 4.

Figure 9:
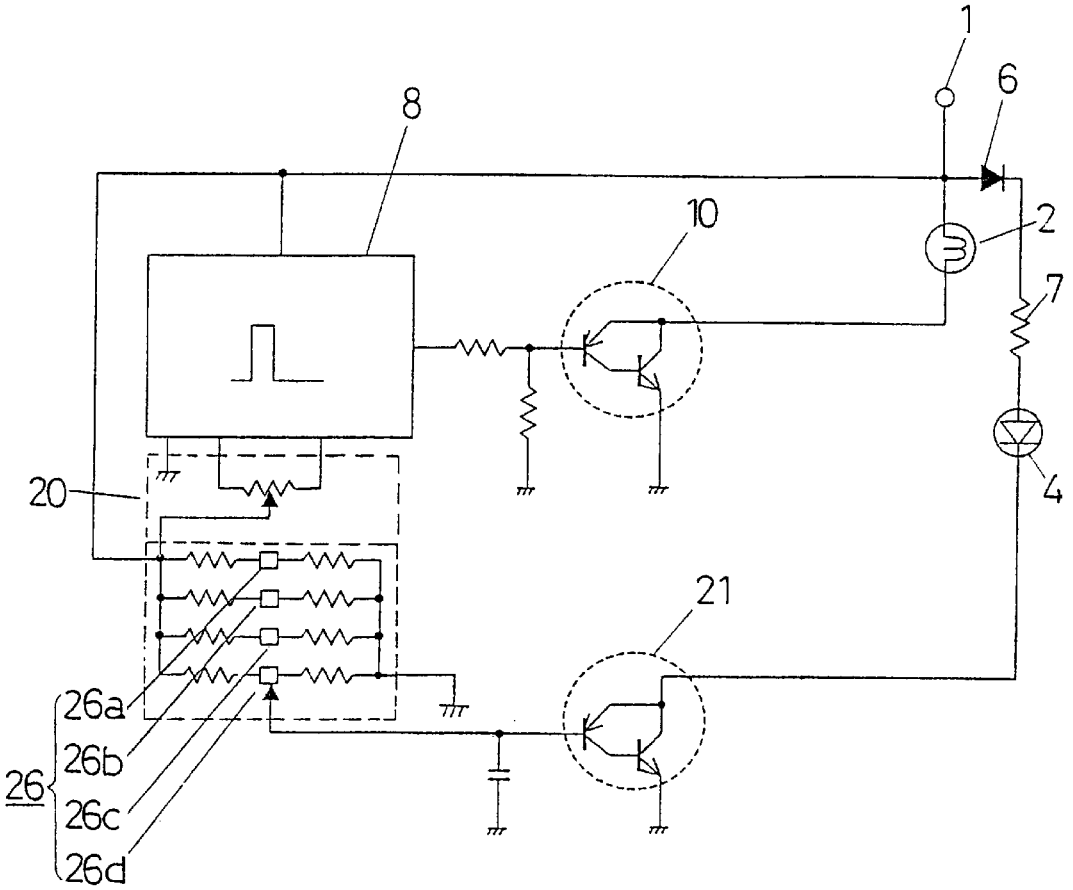
FIG. 9 is a circuit diagram according to anther modified example of the same embodiment.

The above embodiment could also be implemented with a modified example shown in the circuit diagram of FIG. 9. As shown, a fixed resistor 26 consisting of four fixed resistances 26*a* to 26*d* having mutually different resistance values is connected to the LED 4 via the transistor 21, in place of the second variable resistor 22 in FIG. 1. The resistance values of these fixed resistances 26*a* to 26*d* correspond respectively to the resistance values of the first variable resistor 20 at various operating angles of the operating spindle 11. Therefore, light adjustment is performed by switching the first variable resistor 20 and the fixed resistor 26 by operation of the operating spindle 11. According to this arrangement, the light adjustment device for a vehicle can have a simple structure and can be manufactured inexpensively.

Figure 10:
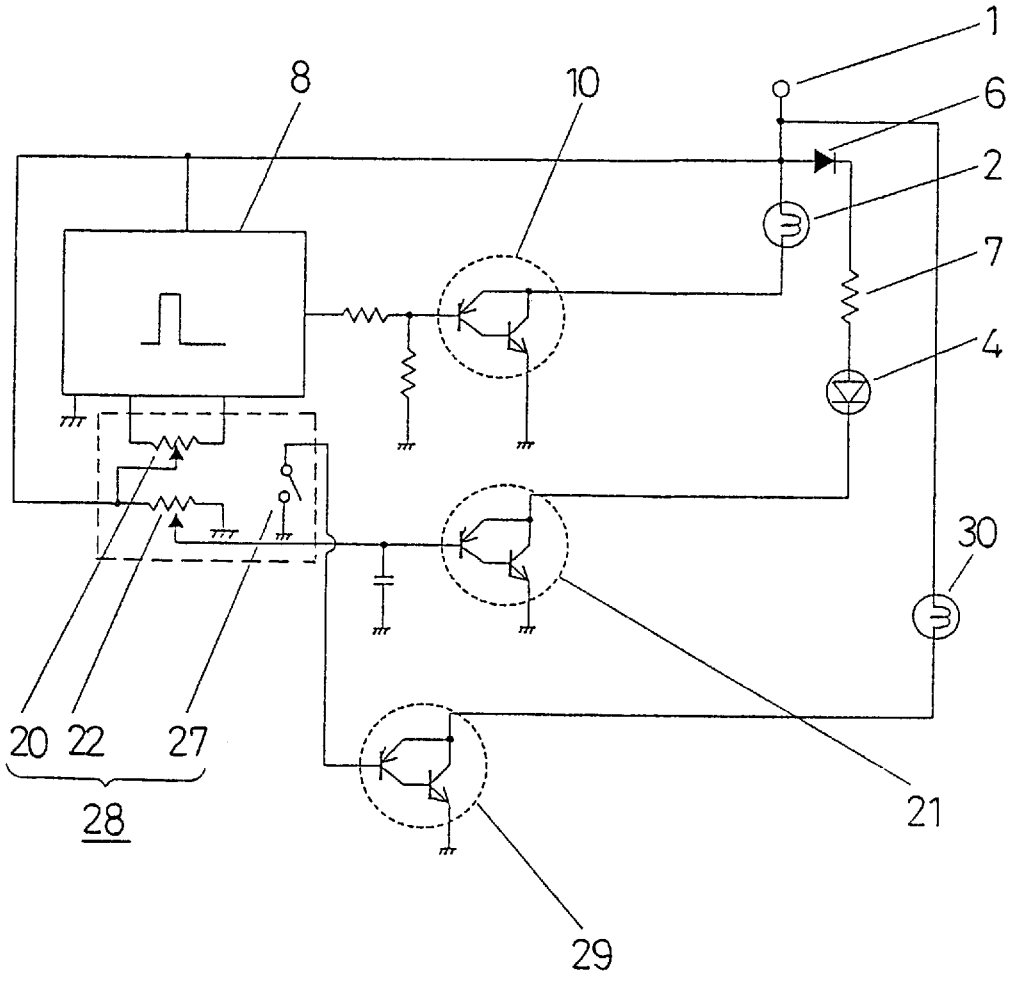
FIG. 10 is a circuit diagram showing a light adjustment device according to a second embodiment of the present invention.
Figure 11:
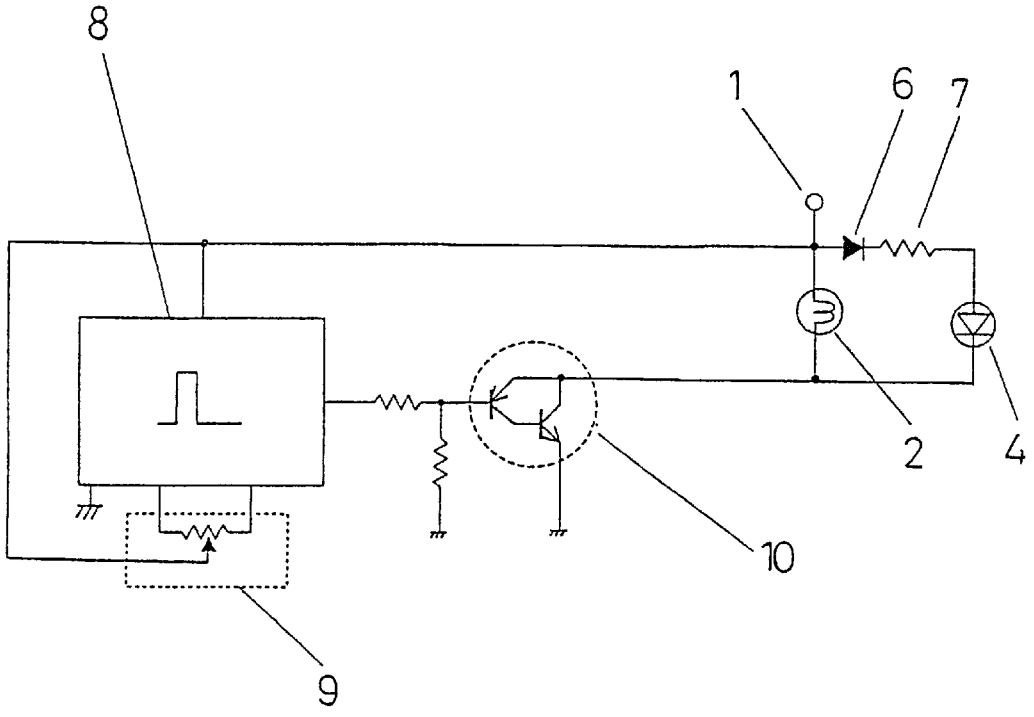
Fig. 11 Prior Art
FIG. 11 is a circuit diagram showing a light adjustment device according to a prior art.
Figure 12:
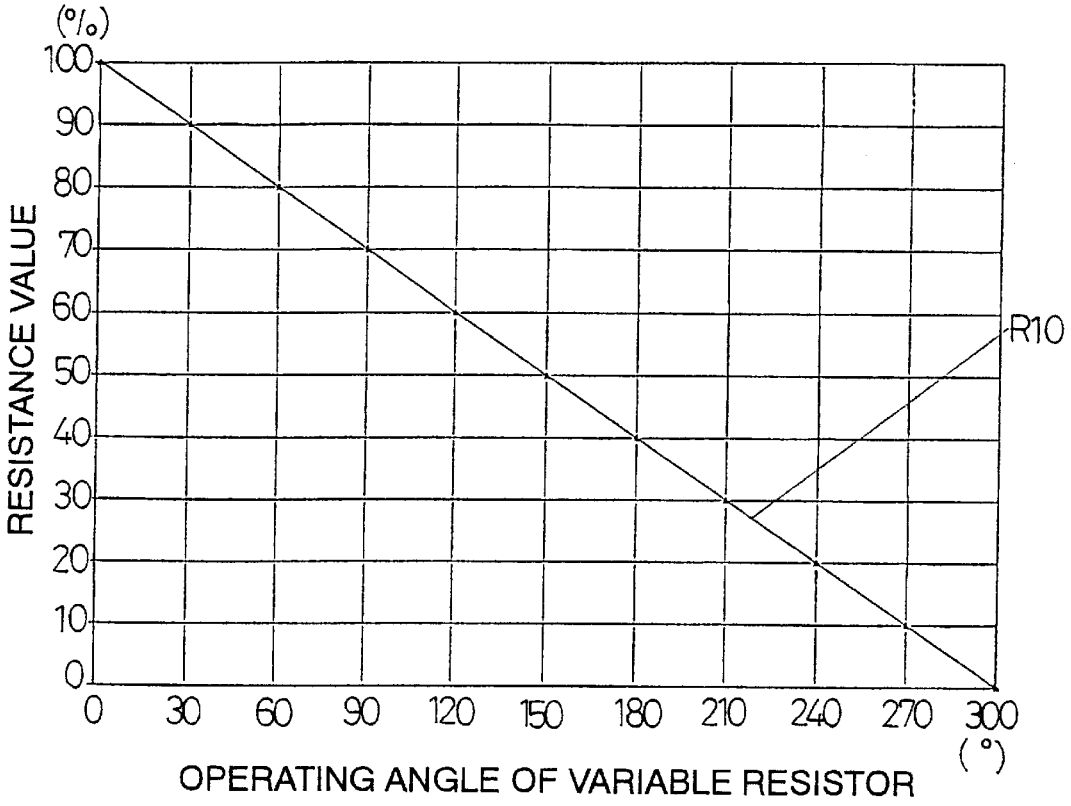
Fig. 12 Prior Art
FIG. 12 is a chart showing the resistance value characteristics of a variable resistor according to the prior art.
Figure 13:
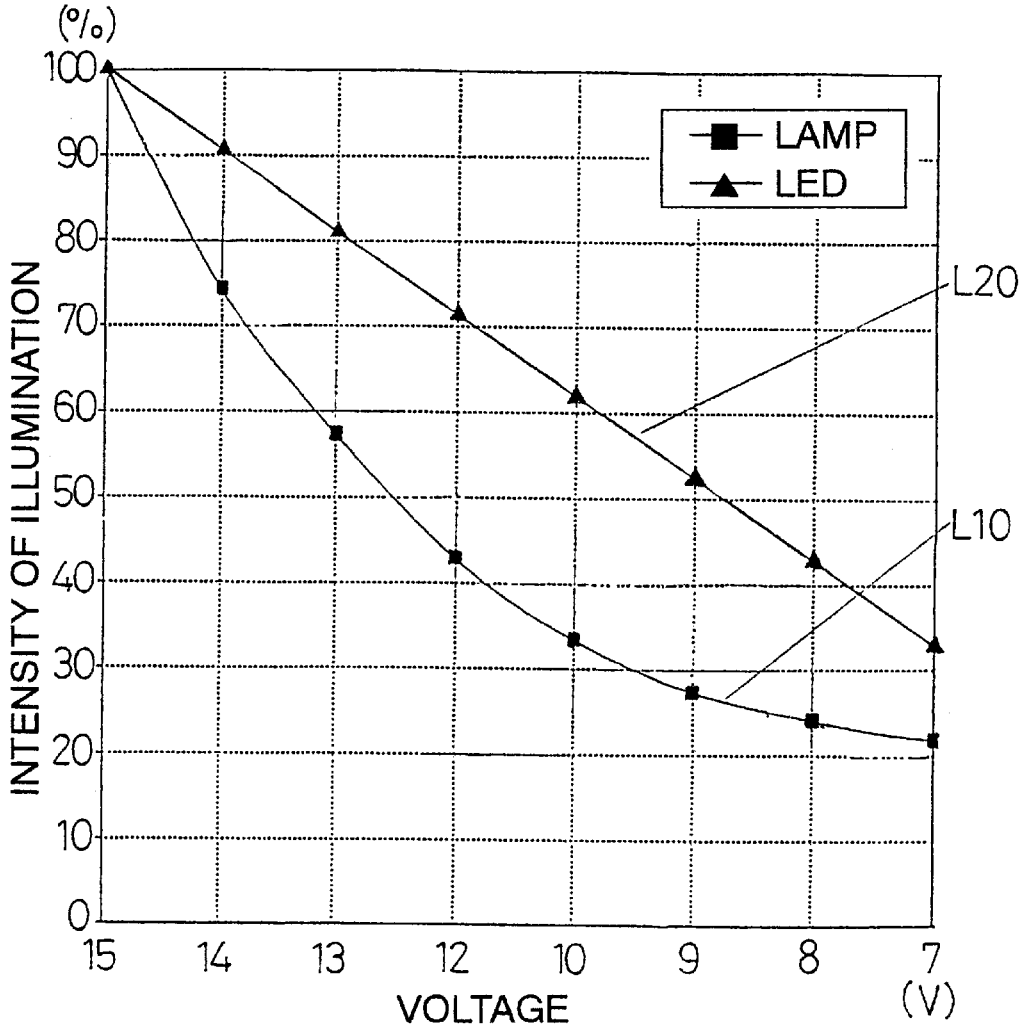
Fig. 13 Prior Art
FIG. 13 is a chart showing the illumination characteristics of a lamp and LED according to the prior art.

A second embodiment of the present invention is described now with reference to the circuit diagram of a light adjustment device for a vehicle shown in FIG. 10. In this second embodiment, similarly to the case of the first embodiment, a rotationally operable first variable resistor 20 is connected to a control circuit 8 connected to a lamp 2 via a transistor 10, and a rotationally operable second variable resistor 22 is connected via a transistor 21 to an LED 4 connected to a diode 6 and a fixed resistance 7. Further, the first variable resistor 20 and the second variable resistor 22 are formed in an integral fashion. However, in this second embodiment, in addition to the first and second variable resistors, a switchable variable resistor 28 is provided, the switch 27 of which is formed integrally in such a manner that the variable resistor.28 can be operated by means of the same operating spindle 11.

The aforementioned switch 27 is connected via a current control transistor 29, to an illumination device located separately from the lamp 2 and LED 4 for illuminating the display panel, for example, to an interior cabin lamp 30 installed in the upper part of the cabin.

In this arrangement, when the operating spindle 11 of the switchable variable resistor 28 is rotated, the resistance values of the first variable resistor 20 and the second variable resistor 22 change, thereby performing light adjustment of the lamp 2 and LED 4 illuminating the display panel, in a similar manner to the case of the first embodiment. Moreover, in the second embodiment, the switch 27 opens and closes at a predetermined operating angle of the operating spindle 11 which controls the switchable variable resistor 28, in such a manner that the interior cabin lamp 30 is switched on or switched off.

According to this second embodiment, it is possible for a vehicle occupant to perform a variety of functional operations, manually, by providing a switch 27 for switching an illumination device other than the illumination devices for a display panel and operating panel where the light is adjusted by a first variable resistor 20 and a second variable resistor 22, for example, for switching an interior cabin lamp 30 installed on the upper part of the cabin, in an integral fashion with the first and second variable resistors.

In the first and second embodiments described above, a first variable resistor 20 and a second variable resistor 22, a first variable resistor 20 and a fixed resistor 26, or first and second variable resistors 20, 22 and a variable resistor 28 formed integrally with a switch 27, have all been described as being operated by means of a single operating spindle, but it is also possible to adopt these as respective elements, in such a manner that each is operated by means of a separate operating spindle.

In the first and second embodiments described above, a control circuit 8 and transistor 10 are connected to the lamp 2 through which a relatively large current passes, whilst a transistor 21 is connected to the LED 4 through which a small current passes, whereby the respective elements are respectively controlled. However, it should be noted that, depending on the current characteristics of the lamp 2, a circuit composition may be adopted wherein a transistor 10 is used alone for control, without employing a control circuit 8.

According to the light adjustment device for a vehicle of the present invention, the respective amounts of illumination of a lamp and LED having mutually different illumination characteristics are caused to be mutually proximate at all times, thereby enabling uniform adjustment of illumination to be performed.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A light adjustment device for a vehicle comprising:

a lamp;

an LED;

a control circuit which is connected to said lamp and outputs a predetermined voltage to said lamp;

a first variable resistor for changing said voltage output from said control circuit, thereby adjusting illumination of said lamp; and a second variable resistor, having resistance value characteristics that are different from resistance value characteristics of said first variable resistor, for adjusting illumination of said LED.

2. The light adjustment device for a vehicle according to claim 1, wherein the first variable resistor and the second variable resistor are operated by an identical operating spindle.

3. The light adjustment device for a vehicle according to claim 1, wherein a plurality of fixed resistors are substituted for at least one of the first variable resistor and the second variable resistor.

4. The light adjustment device for a vehicle according to claim 1, wherein a switch for switching an illumination device other than the lamp and the LED is provided in the vicinity of said first and second variable resistors, or in an integral fashion with same.

* * * * *

UNITED STATES PATENT AND TRADEMARK OFFICE

CERTIFICATE OF CORRECTION

PATENT NO. : 6,329,755 B1
DATED : December 11, 2001
INVENTOR(S) : Y. Nakade et al.

It is certified that error appears in the above-identified patent and that said Letters Patent is hereby corrected as shown below:

Title page,
Item [73], Assignee, the following assignee was omitted and should be included:
-- Toyota Jidosha Kabushiki Kaisha, Aichi (JP) --

Signed and Sealed this

Seventeenth Day of September, 2002

*Attest:*

*Attesting Officer*

JAMES E. ROGAN
*Director of the United States Patent and Trademark Office*